US009890020B2

(12) United States Patent
Willim

(10) Patent No.: US 9,890,020 B2
(45) Date of Patent: Feb. 13, 2018

(54) CRANE, IN PARTICULAR DERRICK CRANE

(71) Applicant: Liebherr-Werk Ehingen GmbH, Ehingen/Donau (DE)

(72) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 338 days.

(21) Appl. No.: 14/840,271

(22) Filed: Aug. 31, 2015

(65) Prior Publication Data

US 2016/0090278 A1 Mar. 31, 2016

(30) Foreign Application Priority Data

Sep. 29, 2014 (DE) ..... 20 2014 007 894 U

(51) Int. Cl.
*B66C 23/76* (2006.01)
*B66C 23/36* (2006.01)

(52) U.S. Cl.
CPC ..... *B66C 23/76* (2013.01); *B66C 23/36* (2013.01)

(58) Field of Classification Search
CPC ..... B66C 23/62; B66C 23/72; B66C 23/74; B66C 23/76; E02F 9/18; B62D 49/085
See application file for complete search history.

(56) References Cited

U.S. PATENT DOCUMENTS

| | | | | |
|---|---|---|---|---|
| 4,729,486 | A * | 3/1988 | Petzold | B66C 23/76 212/197 |
| 6,341,665 | B1 | 1/2002 | Zhou et al. | |
| 6,568,547 | B1 | 5/2003 | Kretschmer et al. | |
| 2011/0031202 | A1* | 2/2011 | Pech | B66C 23/76 212/178 |
| 2015/0210514 | A1* | 7/2015 | Albinger | B66C 23/76 212/279 |
| 2015/0210515 | A1* | 7/2015 | Pech | B66C 23/76 212/197 |

FOREIGN PATENT DOCUMENTS

| | | | |
|---|---|---|---|
| DE | 1007039 | B | 4/1957 |
| DE | 60029709 | T2 | 12/2006 |
| EP | 0989087 | A1 | 3/2000 |
| EP | 1135322 | B1 | 7/2003 |
| EP | 2281771 | A1 | 2/2011 |

* cited by examiner

*Primary Examiner* — Sang Kim
*Assistant Examiner* — Juan Campos, Jr.
(74) *Attorney, Agent, or Firm* — McCoy Russell LLP

(57) ABSTRACT

The present disclosure relates to a crane having a travelable undercarriage and a superstructure which is rotatably supported thereon, to which a boom is luffably connected in an articulated manner, on the one hand, and a counterweight arrangement is telescopically supported, on the other hand. In accordance with the present disclosure, the counterweight arrangement comprises a U-shaped frame in which a likewise U-shaped counterweight frame is telescopically guided. The counterweight plates forming the counterweight are separated into two stacks which are each longitudinally displaceably guided on a side member.

12 Claims, 3 Drawing Sheets

61
613
62
63
22
24
21
7
632
631
645
612
243
242
244

CRANE, IN PARTICULAR DERRICK CRANE

CROSS REFERENCE TO RELATED APPLICATION

This application claims priority to German Utility Model Patent Application No. 20 2014 007 894.7, entitled "Crane, Preferably Derrick Crane," filed on Sep. 29, 2014, the entire contents of which is hereby incorporated by reference in its entirety for all purposes.

TECHNICAL FIELD

The present disclosure relates to a crane, preferably to a derrick crane, having a travelable undercarriage and a superstructure which is rotatably supported thereon, at which a boom is luffably connected in an articulated manner, on the one hand, and at which a counterweight arrangement is telescopically supported, on the other hand.

BACKGROUND AND SUMMARY

Cranes generally utilize a counterweight to generate a moment which counters the working load and thus ensures the stability of the crane. If the counterweight is fixedly connected to the crane, only one defined counterweight moment can always be applied. If the crane is to take up more or less load, the counterweight moment can only be adapted to the current load by stacking up or taking away counterweight plates.

Various deliberations have already been made to remedy this disadvantage. One of these deliberations had the result that the weight of the counterweight is left constant and the effective spacing of the counterweight, that is the counterweight radius, is adapted.

A corresponding crane having a counterweight arrangement which can be telescoped out is thus known from EP 0 989 087 A1.

In '087, a counterweight arrangement is already connected to the superstructure of a derrick crane by a telescopic carrier. The telescopic carrier can be telescoped out or pushed out in accordance with the respective load case or in accordance with the respective luffing angle of the boom so that the counter torque corresponding to the pivot angle of the boom can be generated in a simple manner by a corresponding telescoping out of the counterweight arrangement.

A derrick crane is likewise known from EP 1 135 322 B1 in which a counterweight arrangement is telescopically supported. Therein, the counterweight arrangement is continuously variable in a defined region via a frame element, with the frame element being arranged movable in the vertical plane at the superstructure. The axially fixed frame element is furthermore connected to the superstructure via a vertically acting piston-in-cylinder unit to displace the resulting force between the counterweight force acting in the direction of gravity and the guying force generated by a suspended load into the superstructure as required.

A crane which can also be used as a derrick crane as required is also known from EP 2 281 771 A1 in which the counterweight arrangement can be telescoped out.

In the known cranes having a counterweight arrangement which can be telescoped out, the counterweight arrangement is only displaceable over a limited lengthways region due to the design. In this respect, the counterweight arrangement can typically only be traveled behind the superstructure platform along corresponding carriers which may optionally be able to be telescoped out.

It is the object of the present disclosure to increase the adjustment range for the counterweight arrangement.

This object is achieved in accordance with a crane, such as a derrick crane, which has a travelable undercarriage and a superstructure which is rotatably supported thereon, at which a boom is luffably connected in an articulated manner, on the one hand, and at which a counterweight arrangement is telescopically supported, on the other hand, the crane equipped with a counterweight arrangement comprising a U-shaped frame in which a likewise U-shaped counterweight frame is telescopically guided. The frame and the counterweight frame may each substantially comprise two side members and one cross-member. The counterweight plates forming the counterweight are separated into two stacks which are each longitudinally displaceably guided independent of one another on a side member.

The region in which the counterweight arrangement is displaceable relative to the axis of rotation, that is the axis of rotation of the superstructure about the undercarriage, is substantially increased by the arrangement in accordance with the present disclosure. In accordance with the present disclosure, the counterweight plates which are here arranged longitudinally displaceably at the respective side of the side members can namely be displaced up to be close to the axis of rotation. This has the effect, on the one hand, that a tilting backward of the crane can also be avoided with small load radii. The center of gravity of the total counterweight arrangement can be displaced within the tilting edges of the crawler crane or can be displaced into the quadrangle of the crawler crane formed by the tilting edges by the displaceability of the counterweight plates close to the axis of rotation in accordance with the present disclosure. This advantageously takes place without any complex restacking of the individual counterweight plates such as would be necessary in the solutions in accordance with the prior art. The ballast torque can be adjusted by the wide-ranging displaceability of the counterweight arrangement such that the load torque is always larger than the ballast torque. The guying hereby always has a positive force.

In one example, the U-shaped frame can be connected to the superstructure in an articulated manner pivotable about a luffing axis.

In another example, the counterweight plates forming the counterweight can advantageously be displaceable via trolleys travelable over the side members of the counterweight frame. In this respect, the side members of the counterweight frame and the trolleys displaceably arranged thereon are built symmetric to one another.

In another example, the counterweight plates can be displaceable from a position close to the axis of rotation of the superstructure about the undercarriage via the corresponding trolleys into an end position at the outer ends of the side members of the counterweight frame before the counterweight frame is telescoped out of the frame together with the counterweight plates as required. In accordance with this example embodiment, on the pushing out of the counterweight, that is of the ballast, the ballast can always first be displaced completely up to the end position on the outer frame before the counterweight frame is pushed out. On the traveling inward of the ballast, the counterweight frame is first completely moved in before the ballast is displaced on the frame.

The position of the ballast can be monitored via corresponding length sensors. In this respect, the deployment states of the ballast on the respective side, that is to the left and to the right of the articulation point of the U-shaped frame at the superstructure up to the center of the counterweight plates, can be measured. The deployment state of the counterweight frame can also be measured at the left and at the right and thus also in a redundant manner.

The crane advantageously has a derrick boom which is pivotably connected to the superstructure in an articulated manner and from whose one end a preferably length-variable guying is connected to the counterweight frame.

In one example, the U-shaped frame of the counterweight arrangement pivotably connected to the superstructure in an articulated manner can particularly advantageously be connected to the superstructure also via a vertically acting displacement means. In one example embodiment in accordance with the present disclosure, the revolving deck ballast typically provided on the superstructure can be omitted. In accordance with the aforesaid example embodiment, the force is generated by the counterweight frame pivotably connected to the superstructure in an articulated manner to replace the force which the revolving deck ballast typically generates on the revolving deck. For this purpose, the counterweight frame is connected to the superstructure via the vertically acting displacement means. This principle of this approach is known from EP 1 135 322 B1.

In accordance with a further example embodiment of the present disclosure, a support device may be arranged at the counterweight frame. The support device ensures that, in the event of a breaking away of the load and thus a backward tilting of the crane, the counterweight arrangement can be quickly supported at the ground so that a further tilting is prevented. The vertical adjustability of the support device advantageously serves to compensate different levels or profiles of the ground.

A cross-frame which is inwardly movable into a support apparatus arranged at the superstructure may be arranged at the counterweight frame. The counterweight frame may be supported at the superstructure via the cross-frame which can be moved inwardly into the support apparatus. The support apparatus can therefore downwardly limit the degree of freedom of the frame about its luffing axis. In this case, the weight of the counterweight arrangement is directly supported by the superstructure if no derrick boom is used.

In a further embodiment of the present disclosure, the trolleys can be movable on the side members of the counterweight frame via hydraulic cylinders. In the same way, the U-shaped frame and the U-shaped counterweight frame can be mutually telescopable via hydraulic cylinders.

Further features, details and advantages of the present disclosure will be explained with reference to an embodiment shown in the figures.

DETAILED DESCRIPTION

FIGS. 1A through 3C show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

Figures 3A, 3B, 3C:
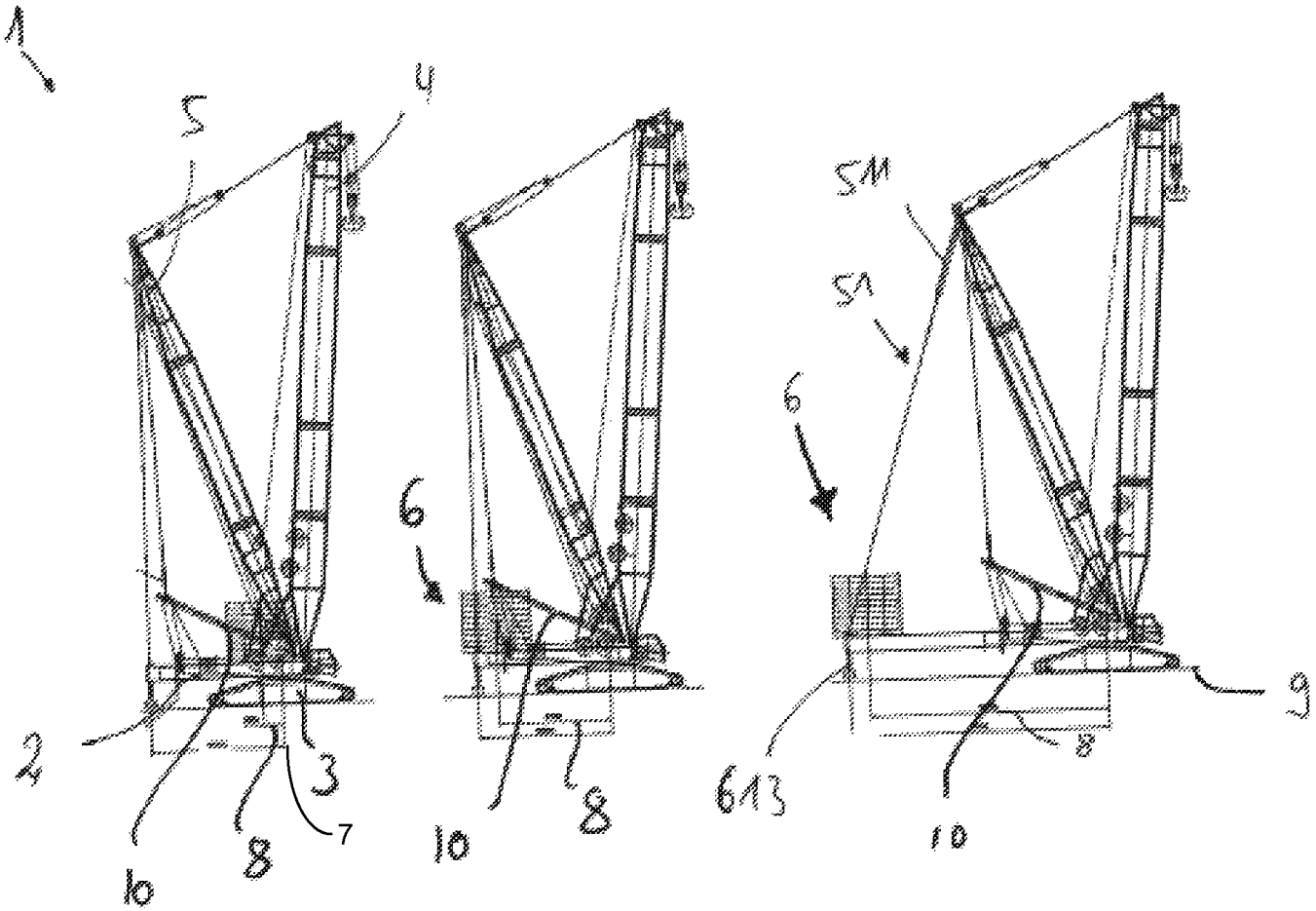
FIG. 3A shows one lateral representation of the crane in accordance with the present disclosure showing a certain position of the counterweight frame.
FIG. 3B shows another lateral representation of the crane in accordance with FIG. 3A with a different position of the counterweight frame.
FIG. 3C shows another lateral representation of the crane in accordance with FIGS. 3A and 3B, in a further different position of the counterweight frame.

In an embodiment shown in FIGS. 3A, 3B and 3C, a crawler crane 1 is shown as the crane. It consists of a superstructure 2, an undercarriage 3, a main boom 4 and a counter-boom 5 having a variable counterweight arrangement 6.

As can already be seen from FIGS. 3A-C, the counterweight arrangement 6 is telescopically supported relative to the superstructure 2. The counterweight arrangement can be arranged at a position close to the axis of rotation 7 about which the superstructure 2 is rotatably supported about the undercarriage 3, as is shown in FIG. 3A. From this starting position, the counterweight arrangement can be traveled or telescoped out continuously into different positions, as is shown in FIGS. 3B and 3C.

Figures 1A, 1B, 1C, 1D:
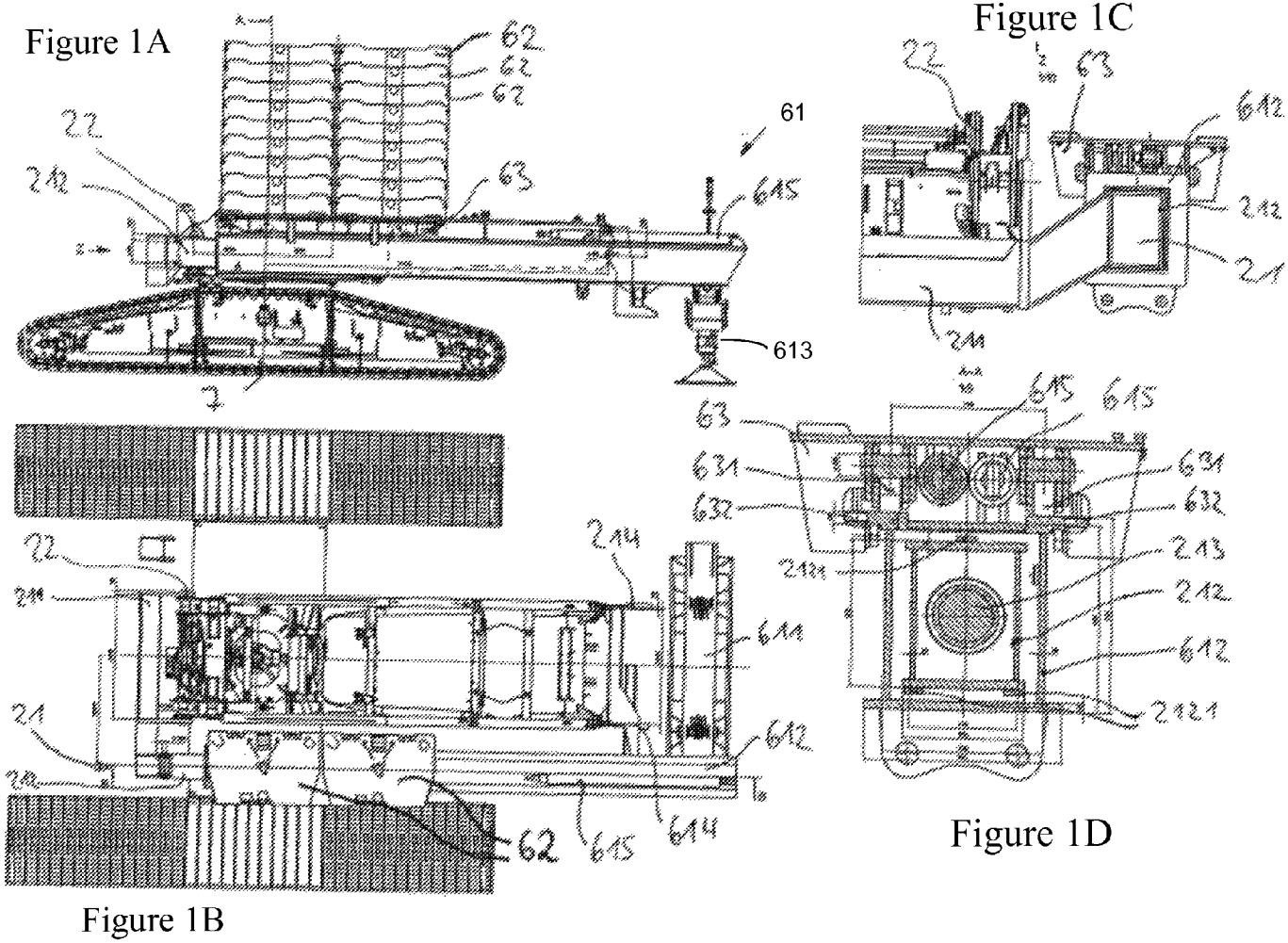
FIG. 1A shows a side view of a part of the crane in accordance with the present disclosure.
FIG. 1B shows a plan view of the part of the crane as shown in FIG. 1A in accordance with the present disclosure.
FIG. 1C shows a detailed view in the direction of gaze z in accordance with FIG. 1A.
FIG. 1D shows a cross-section along the line A-A in accordance with FIG. 1A.

It can be seen individually from FIGS. 1 and 2 how the counterweight arrangement is telescopically supported relative to the superstructure in the embodiment shown here. A U-shaped frame 21 is attached to the superstructure 2 for this purpose. The U-shaped frame 21 is, as shown in FIG. 1B, supported in the region of the luffing axis of the main boom 4 (as seen in FIG. 3A) about a corresponding luffing axis 22. The frame 21 comprises a cross-member 211 and two side members 212. A U-shaped counterweight frame 61 can be telescoped out with respect to this U-shaped frame 21. The counterweight frame 61 (FIG. 1A) likewise substantially comprises a cross-member 611 and two side members 612.

As shown in FIG. 1D, a telescopic cylinder 213 serves as a drive for the telescopic movement of the counterweight frame 61 with respect to the frame 21. Since two respective side members 212 are present, two telescopic cylinders 213 are to be provided. The counterweight frame 61 can be adjusted under load due to this arrangement.

Due to the provision of the U-shaped frame or of the U-shaped counterweight frame cooperating therewith, a ballast device is provided which has two symmetrical halves respectively arranged at the sides of the superstructure. Respective trolleys 63 are displaceably guided on the side members 612 of the counterweight frame 61 and the counterweight plates 62 forming the actual ballast are stacked thereon.

In accordance with FIG. 1B, two stacks of counterweight plates 62 are provided arranged behind one another. The stacks are advantageously arranged behind one another so that they can be designed to be very small. The trolley 63 (FIG. 1D) arranged travelable on the side member 612 has a hydraulic cylinder 615 as the drive. However, any other drive can be used instead of a hydraulic drive.

Since the trolley 63 covers large distances, a multistage hydraulic cylinder 615 is advantageous. To keep the oil quantity in a justifiable framework, two multistage hydraulic cylinders 615 can be used in opposite directions. One cylinder 615 is thus always filled with hydraulic fluid. The control can be kept simple in that two plunger cylinders are used with one cylinder operating in each direction. A respective cylinder can hereby press back another cylinder arranged next to it.

One half of the counterweight arrangement 6 is shown with a trolley 63 in FIG. 1B. A corresponding trolley 63 with counterweight plates is symmetrically provided at the oppositely disposed side.

A trolley 63 is provided in each half of the counterweight arrangement 6 due to the divided arrangement of the counterweight plates and to the corresponding guidance on the side member 612. The space between the trolleys 63 thus remains free for the typically used crane components. The center of gravity of the counterweight arrangement 6 can be displaced particularly far in the direction of the axis of rotation 7 between the superstructure 2 and the undercarriage 3 due to this design since the front end of the trolley 63 is already located directly in front of the axis of rotation 7. To make this possible, a guying 51 to the derrick boom 5 (shown in FIG. 3C) is also not connected to the trolley 63, but rather to the counterweight frame 61.

Since the left and right trolleys 63 are not connected to one another, they cannot mutually stabilize themselves. The trolleys 63 are displaceable independently of one another. Each trolley 63 requires a complete guide such as is shown in FIG. 1D. The carrier rollers 631 of the trolley 63 are shown here which transfer the entire weight into the side members 612. Lateral guide rollers 632 ensures that the trolley 63 remains on the side member 612.

Some of the support between the side members 612 and 212 can furthermore be recognized in FIG. 1D. This support takes place here via plastic slide shoes 2121 already known for this purpose.

As shown in FIG. 1A, the counterweight frame 61 has a support device 613. The support device 613 ensures that, in the event of a breaking away of the load and thus of a backward tilting of the crawler crane 1, a support of the counterweight arrangement 6 at the ground is possible fast so that a further tilting can be prevented. The support device 613 can in this respect be adjustable such that different levels or profiles of the ground 9, which is the horizontal plane as shown in FIG. 3C can be compensated.

Figures 2A, 2B, 2C:
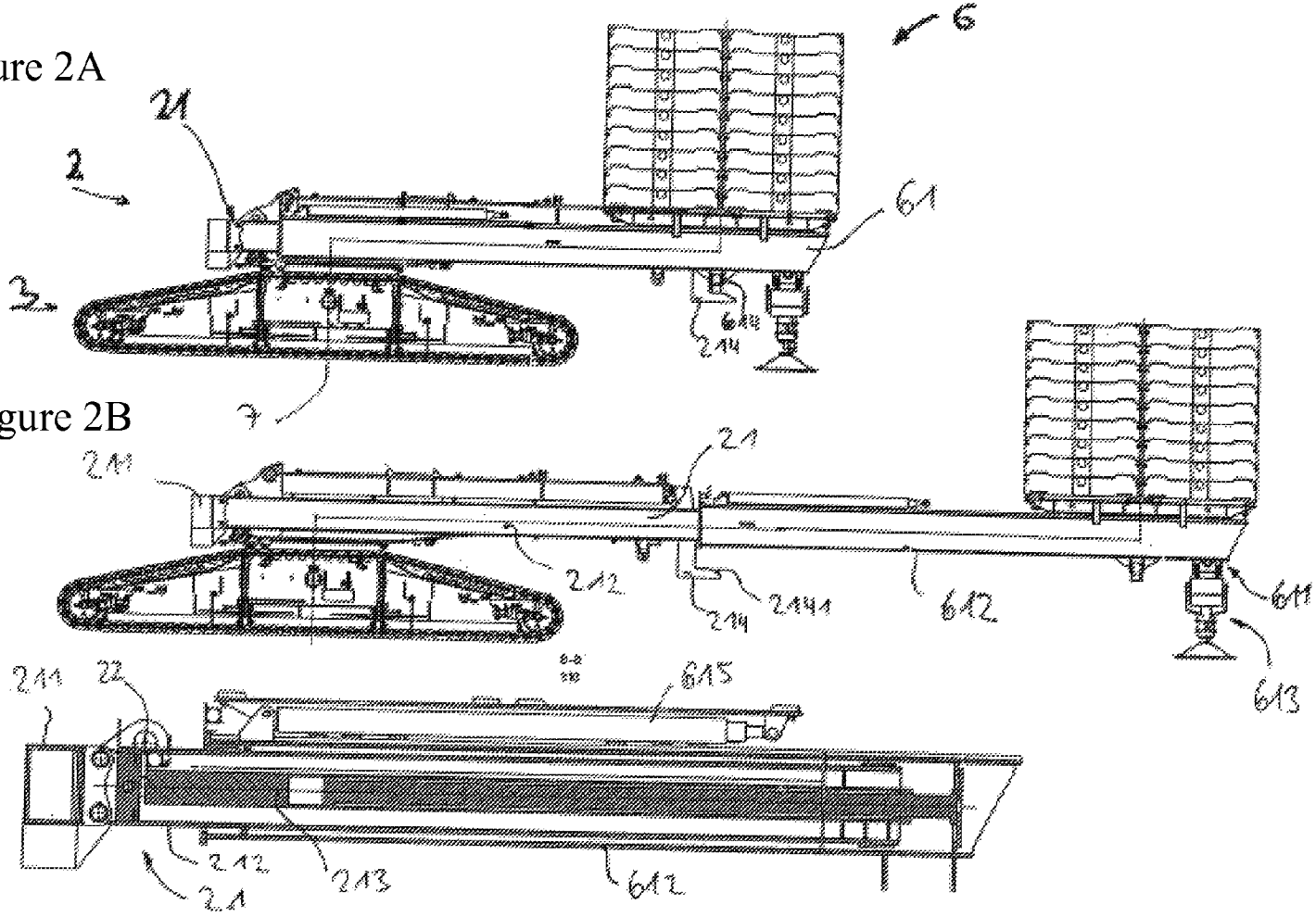
FIG. 2A shows a representation of the crane in accordance with FIG. 1A showing a certain position of the counterweight arrangement.
FIG. 2B shows a representation in accordance with FIGS. 1A and 2A showing a different position of the counterweight arrangement.
FIG. 2C shows a section corresponding to the line B-B in accordance with FIG. 1B.

In FIG. 2A, the counterweight frame 61 is supported at the superstructure 2 in the inwardly telescoped state. A cross-frame 614 is provided for this purpose at the counterweight frame 61. The cross-frame 614 can move into a support apparatus 214. As shown in FIG. 2B, the support at the superstructure 2 can be independently established via a guide 2141 on the inward telescoping. The support apparatus 214 can be received at existing bolting points for retrofitting. These bolting points can be the connection points to an otherwise present suspended ballast or to an otherwise present ballast box. The support apparatus 214 serves to limit the degree of freedom of the frame 21 downwardly about the luffing axis 22 (luffing axis as shown in FIGS. 1C and 2C). The weight of the counterweight arrangement 6 is thus directly carried by the superstructure if no derrick boom is used.

So that the crawler crane 1 is travelable and the superstructure 2 can be rotated about the undercarriage, the support device 613 naturally may not be supported on the ground 9. A guying 51 is typically provided for this purpose between the free end of the derrick boom 5 and the counterweight frame 61. The guying 51 can be length variable. The adjustment can take place in a known manner via a hydraulic cylinder 511 (as seen in FIG. 3C). The guying 51 transfers the larger part of the load torque directly into the counterweight arrangement 6 and raises it from the ground.

In one alternate embodiment, a counter-boom or a derrick boom 5 may not be used. To the extent that the counterweight frame 61 is completely inwardly traveled, as is shown in the middle representation in accordance with FIG. 3B, the counterweight radius 8 can nevertheless be further reduced in size in order also to avoid a backward tilting of the crane with smaller load radii. For this purpose, the counterweight arrangement 6 is displaced close to the axis of rotation 7, as is shown in FIG. 3A. The total counterweight arrangement here lies within the tilting edges of the crawler crane 1. This may be possible in accordance with the present disclosure without a complex restacking of the individual counterweight plates 62 since the counterweight plates 62, as already shown in detail above, can be displaced on the trolley 63 along the side members 612 of the counterweight frame 6 up to close to the axis of rotation 7. This is made possible, as already stated, in that the counterweight arrangement 6 splits into a left half and into a right half so that the counterweight arrangement can be displaced without considering obstacles projecting centrally on the superstructure. It can hereby be effected by a corresponding arrangement of the total counterweight arrangement that the load torque is always larger than the ballast torque so that the guying to the SA block 10 always has a positive force.

A standard crawler crane can advantageously be retrofitted using the existing connection points and existing free spaces in accordance with the present solution in accordance with the present disclosure.

The invention claimed is:

1. A crane comprising:

a travelable undercarriage;

a superstructure rotatably supported on the undercarriage;

a boom luffably connected to the superstructure in an articulated manner on one side of the superstructure, and a counterweight arrangement telescopically supported by the superstructure on a another side of the superstructure, wherein the counterweight arrangement comprises a U-shaped frame in which a U-shaped counterweight frame is telescopically guided, with the frame and the counterweight frame each comprising two side members and a cross-member; and wherein counterweight plates forming the counterweight are separated into two stacks which are each longitudinally displaceably guided independently of one another on a side member.

2. The crane in accordance with claim 1, wherein the U-shaped frame is connected to the superstructure pivotable about a luffing axis in an articulated manner.

3. The crane in accordance with claim 1, wherein the counterweight plates are displaceable via trolleys travelable on the side members of the counterweight frame.

4. The crane in accordance with claim 3, wherein the counterweight plates are displaceable via the trolleys from a position close to an axis of rotation of the superstructure about the undercarriage into an end position at outer ends of the side members of the counterweight frame before the counterweight frame is telescoped out of the frame together with the counterweight plates.

5. The crane in accordance with claim 3, wherein the trolleys are travelable on the side members of the counterweight frame via hydraulic cylinders.

6. The crane in accordance with claim 1, further comprising a derrick boom pivotably connected to the superstructure in an articulated manner, wherein from a free end of the derrick boom, a length-variable guying is connected to the counterweight frame.

7. The crane in accordance with claim 1, wherein the U-shaped frame of the counterweight arrangement pivotably connected to the superstructure in an articulated manner is additionally connected to the superstructure via a vertically acting displacement device.

8. The crane in accordance with claim 1, wherein a vertically adjustable support device is arranged to the counterweight frame.

9. The crane in accordance with claim 1, wherein a cross-frame which can be traveled into a support apparatus arranged at the superstructure is arranged at the counterweight frame.

10. The crane in accordance with claim 1, wherein the U-shaped frame and the U-shaped counterweight frame can be mutually telescoped via hydraulic cylinders.

11. The crane of claim 1, wherein the crane is a derrick crane.

12. The crane of claim 1, wherein the one side and the another side are opposite sides of the superstructure.

* * * * *